US005312075A

United States Patent [19]

Kuhn

[11] Patent Number: 5,312,075

[45] Date of Patent: May 17, 1994

[54] RAILROAD FROG

[75] Inventor: Stephen R. Kuhn, Richton Park, Ill.

[73] Assignee: ABC Rail Corporation, Chicago, Ill.

[21] Appl. No.: 806,377

[22] Filed: Dec. 13, 1991

[51] Int. Cl.[5] ..... E01B 7/10

[52] U.S. Cl. ..... 246/455; 246/468

[58] Field of Search ..... 246/454, 455, 456, 460, 246/461, 463, 464, 468, 471, 472; 238/17, 18, 122, 124, 148

[56] References Cited

U.S. PATENT DOCUMENTS

| | | | |
|---|---|---|---|
| 718,297 | 1/1903 | Angerer | 246/456 |
| 902,589 | 11/1908 | Lucas | 246/455 |
| 1,120,558 | 12/1914 | Steedman | 246/455 |
| 3,480,072 | 11/1969 | Heim et al. | 246/468 X |
| 4,362,282 | 12/1982 | Frank | 246/468 |
| 4,469,299 | 9/1984 | Csontos | 246/455 X |
| 4,624,428 | 11/1986 | Frank | 246/468 X |
| 4,637,578 | 1/1987 | Frank | 246/449 X |

FOREIGN PATENT DOCUMENTS

| | | | |
|---|---|---|---|
| 1172976 | 8/1985 | U.S.S.R. | 246/435 R |

*Primary Examiner*—Michael S. Huppert
*Assistant Examiner*—Scott L. Lowe
*Attorney, Agent, or Firm*—Thomas S. Baker, Jr.

[57] ABSTRACT

A railbound manganese frog assembly having ramps and grooves adapted to receive the false flange formed on the rim of a worn railroad car wheel to prevent the flange from impacting components of the frog assembly.

16 Claims, 7 Drawing Sheets

RAILROAD FROG

BACKGROUND OF THE INVENTION

A railroad frog is a device which is inserted at the intersection of a mainline rail and a turnout line rail to permit the flanges of wheels moving along one of the rails to pass across the other. The frog supports the wheels over the missing tread surface between the frog throat and the frog point and provides flangeways for aligning the wheels when passing over the point so that they will be afforded the maximum bearing area. Generally, standard turnout frogs may be classified as rigid frogs which have no movable parts or movable wing frogs in which one or both of the wings move outward to provide flangeways for railroad car wheels. The rigid frogs include manganese railbound frogs, solid manganese frogs and self guarded frogs. Movable frogs include railbound manganese spring frogs.

Rigid railbound manganese frogs are constructed by combining carbon steel rails with manganese steel castings. Railbound manganese spring frogs have a rigid, carbon steel, wing rail which encompasses a wing which is formed on a manganese steel cast insert and which is aligned substantially with a long point or heel rail connected to a turnout traffic rail and a flexible spring wing rail which is aligned substantially with a short point or heel rail which is connected to a mainline traffic rail.

Railbound manganese frogs are preferred over frogs which do not encompass manganese castings inasmuch as manganese steel has a resistance to abrasion and impact which exceeds that of carbon steel by as much as ten times.

In recent years, the frequency, the weight and the speed of rail traffic have increased. Consequently, the wear surfaces of manganese insert castings in railbound manganese frogs have been found to fail and become unacceptable for use within relatively short periods of time in certain zones. This increased wear and failure of the manganese insert casting has been found to occur primarily at three wheel transfer zones within the frog. The wear and failure occurs in these zones primarily because of wheel transfer impacts. Wheel transfer impacts normally occur as a result of an abrupt change in the path of a wheel and because of changes which occur in the wheel's profile as the wheel wears.

Railroad car wheels are made of either wrought steel or cast steel and have a carbon content of between 0.65% and 0.77% which approximately equals the carbon content of rail steel. Making the composition of railroad car wheels substantially the same as rails extends the wear life of both elements. However, when in use over a period of time the shape of a railroad car wheel changes substantially. This change in shape contributes greatly to failure of manganese insert castings caused by wheel transfer impacts as will be explained hereinbelow. The change in shape of a railroad car wheel with wear may be seen by referring to FIG. 3 of the drawings. This figure represents a part sectional view of the tread of a railroad car wheel. The dotted lines represent a new railroad car wheel whereas the solid lines depict a car wheel which has reached the condemning limits of wear and must be removed from service. When a wheel is new, the tread tapers inwardly from the inside of the flange to the outside edge of the wheel. This taper amounts to approximately one inch in twenty inches. In service, the inner vertical edge of the wheel flange bears against the gage side of a rail head, this being the side of the rail that faces the rail on the opposite side of the tie and the wheel tread bears against the top surface of a rail head. Consequently, the gage side of a wheel flange wears as does the tread of the wheel adjacent the flange. This wear may be seen by referring to FIG. 3 which illustrates the erosion of the gage side of the wheel flange and the loss of metal on the wheel tread adjacent the flange. The flange of a new wheel has a thickness of 1.375 inches and a depth of one inch. The wheel must be removed from service when the flange thickness decreases to 0.9375 inches or the flange depth increases to 1.50 inches. As a wheel wears, a false flange develops on the wheel opposite the flange which bears against the gage line of the rail. The false flange impacts the components of a manganese frog in the wheel transfer zones and contributes to or results in surface failure of the manganese insert castings.

As mentioned above, there are three primary transfer zones where the false flange formed on a worn railroad car wheel may cause damage to the manganese insert of a frog through impact. The first zone occurs at the toe end of the frog adjacent the throat of the insert. In this area the flange of a railroad car wheel transfers from a wing rail to a wing formed on the manganese insert as the wheel approaches the tip of the insert point moving in a facing direction. Movement in a facing direction for a railroad car wheel occurs as the wheel moves from the toe end of the frog to the heel end of a frog whereas a wheel undergoes a trailing direction movement when it passes from the heel end of a frog to the toe end of a frog. A second transfer zone where the false flange of a wheel may damage a surface of a manganese insert occurs as a wheel passes from a manganese wing to a running surface on the point of the insert. The third zone where the false flange on a railroad car wheel may impact a surface on the frog occurs at the heel end of the frog where a heel rail attaches to a heel extension formed at one end of the manganese insert point in alignment with the running surfaces of the point. In part, the impact is created by the physical discontinuity or gap which occurs at the interface of the manganese heel extension and the high carbon heel rail. In this location the traditional manganese casting has the smallest cross sectional area which gives rise to the greatest amount of wear.

Thus, it becomes desirable to provide manganese railroad frogs which accommodates worn railroad car wheels having false flanges in such a manner that the false flanges are prevented from impacting surfaces on the manganese casting to prevent unnecessary wear.

SUMMARY OF THE INVENTION

A frog assembly having a toe end and a heel end is adapted to be inserted at the intersection of a mainline rail and a turnout rail. The assembly has a base plate and a longitudinally extending manganese insert with a heel end having a point commencing at the intersection of the mainline and turnout line gage lines and a heel extension connected to said point and a toe end having at least one rigid manganese wing which extends along one side of said frog point to define a wheel flangeway therebetween mounted on said base plate. The manganese insert point has a top surface which defines a mainline running surface and a turnout line running surface for railroad car wheels and a pair of side surfaces. A rigid wing rail has a turnout line wheel running surface section, a manganese wing receiving section which receives said manganese wing and a rigid wing guard rail section mounted on said base plate. The rigid manganese wing provides a transition surface between the rigid wing rail wheel running surface section and the turnout running surface on the point and the rigid wing rail guard section extends along and parallel to the heel of the insert such that a wheel flangeway is defined between one of the insert side surfaces and the rigid wing rail guard section. A first heel rail is mounted on the base plate and attached to the heel extension to abut the mainline running surface on the point and a second heel rail is mounted on the base plate and attached to the heel extension to abut the turnout running surface on the point. The first heel rail cooperates with the rigid wing rail guard section to define a wheel flangeway therebetween. A ramp adapted to receive a false flange on a railroad car wheel is formed in the top surface of the head of the rigid wing rail parallel to the turnout line wheel running surface of the rigid wing rail. This ramp extends upwardly from approximately 0.375 inches below the rail top surface at one end of the wing receiving section to the rail top surface approximately one half the distance to the point of frog. A frog assembly having a toe end and a heel end is adapted to be inserted at the intersection of a mainline rail and a turnout rail. The assembly has a base plate and a longitudinally extending manganese insert with a heel end having a point commencing at the intersection of the mainline and turnout gage lines and a heel extension connected to the point and a toe end having a left hand manganese wing and a right hand manganese wing which extend along each side of the frog point to define a wheel flangeway therebetween mounted on the base plate. The manganese insert has a top surface which defines a mainline running surface and a turnout line running surface for railroad car wheels. A right hand wing rail which has a mainline wheel running surface section has a right hand manganese wing receiving section which receives the right hand manganese wing and a right hand guard rail section mounted on the base plate. A left hand wing rail which has a turnout wheel running surface section has a left hand manganese wing receiving section which receives the left hand manganese wing and a left hand guard rail section mounted on the baseplate. The right hand manganese wing provides a right hand transition surface between the right hand wing rail wheel running surface section and the mainline running surface on the point whereas the left hand manganese wing provides a left hand transition surface between the left hand wing rail wheel running surface section and the turnout line running surface on the point. A right hand heel rail is mounted on the baseplate and attached to the right hand side of the heel extension to abut the turnout line running surface on the point and a left hand heel rail is mounted on the baseplate and attached to the left hand side of the heel extension to abut the mainline running surface on the point. A ramp adapted to receive a false flange on a railroad car wheel is formed in the top surface of the head of the right hand wing rail parallel to the mainline wheel running surface of the right hand wing rail which ramp extends from one end of the wing receiving section to approximately one-half the distance to the point of frog. A ramp adapted to receive a false flange on a railroad car wheel also is formed on the top surface of the head of the left hand wing rail parallel to the turnout line running surface of the left hand wing rail which ramp extends from one end of the wing receiving section to approximately one-half the distance to the point of frog.

DESCRIPTION OF THE PREFERRED EMBODIMENTS

Figure 3:
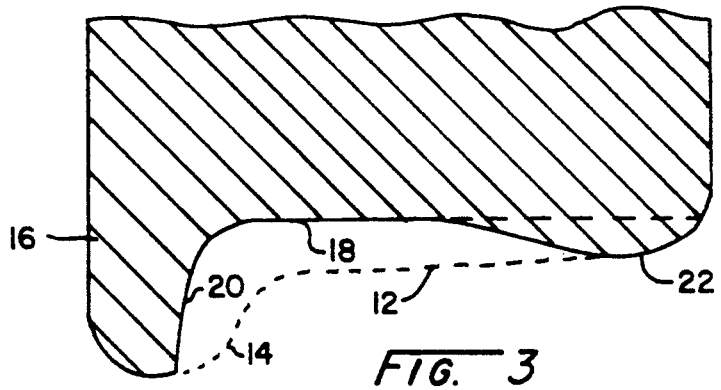
FIG. 3 is a part cross sectional view showing the flange and tread outline of a new wheel in dotted lines and the flange and tread outline of a worn wheel in solid lines.

The manganese railbound rigid frog and the manganese railbound spring frog of the present invention prevent undesirable wheel impacts at the wheel transfer zones in manganese frogs. As mentioned previously, wheel transfer impacts normally occur as the result of a change in the path of a wheel and because of changes which occur in a railroad car wheel's profile as the wheel wears. FIG. 3 of the drawings illustrates the profile of a railroad car wheel at the beginning and at the end of its useful life. Number (10) identifies a new wheel whereas number (10A) denotes a worn wheel. The dotted line (12) represents the tread of a new railroad car wheel (10) having a taper of approximately one inch in twenty inches whereas the dotted line (14) illustrates the vertical inner or contact surface (14) which engages the gage side of a rail of the flange (16) of the new wheel (10). The solid line (18) depicts the tread of a worn wheel (10A) and the solid line (20) shows the inner or contact surface of the worn railroad car wheel (10A) which has reached the condemning limit of wear and must be removed from service. It may be observed that as the tread (12) and the vertical inner surface (14) of flange (16) which contacts the gage side of a rail wears a false flange (22) develops on the wheel (10) opposite the flange (16) and causes it to become a worn wheel (10A). The false flange (22) impacts the components of a conventional manganese frog in the wheel transfer zones and contributes to the failure of the manganese insert castings.

The present invention provides an improved railbound manganese rigid frog and an improved railbound manganese spring frog which have greatly increased resistance to wear caused by wheel impacts which occur because of changes in the wheel's profile during the useful life of a wheel.

Figure 1:
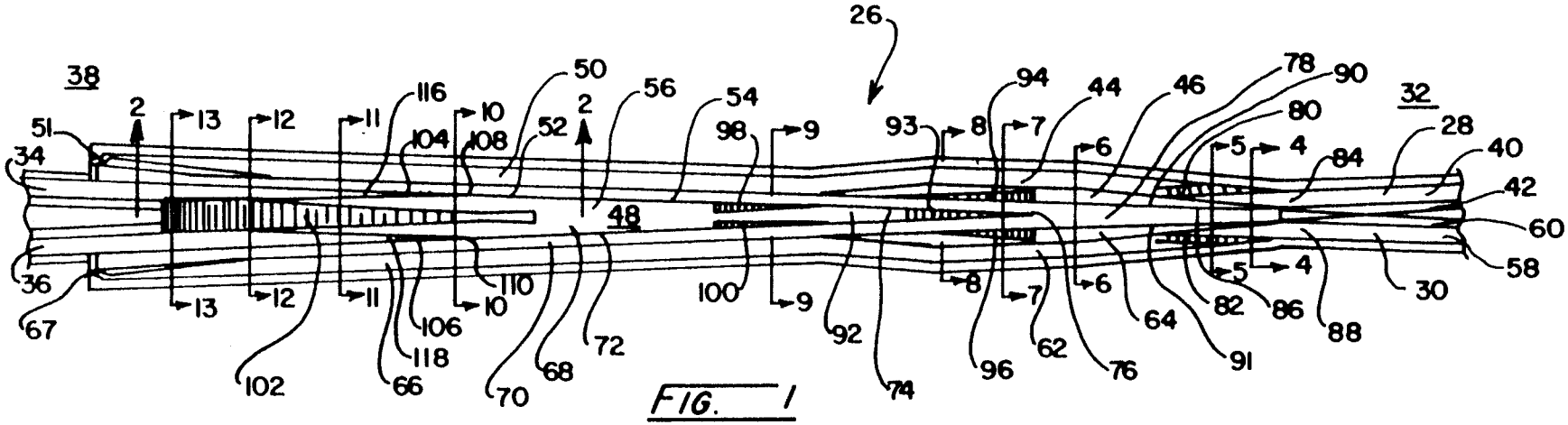
FIG. 1 is a plan view of a rigid railbound manganese frog of the subject invention.

FIG. 1, depicts a railbound manganese rigid frog (26) of the present invention. Ordinarily frogs are classified either as left hand or as right hand. A frog is considered left hand when the turnout gage line is on the left hand side of the point and the mainline gage line is on the right hand side of the point as the point is viewed looking from the toe end towards the heel end of the frog. A frog would be considered right hand if the turnout gage line is on the right hand side of the point and the mainline gage line is on the left hand side of the point as viewed from the toe end looking towards the heel end of the frog. The railbound manganese frog (26) of the present invention will fit a left hand or right hand frog application because it is symmetrical about a longitudinal centerline. However, for purposes of this description frog (26) will be described as having the turnout gage line on the right hand side of the point and the mainline gage line on the left hand side of the point. Thus, frog (26) will be described as a right hand frog.

Referring again to FIG. 1, frog (26) has a right hand wing rail (28) and a left hand wing rail (30). The right hand and left hand wing rails (28 and 30) connect to mainline and turnout traffic rails not shown at the toe end (32) of frog (26). Right hand and left hand heel rails (34 and 36) are attached to frog (26) at the heel end (38) thereof as will be described in more detail hereinbelow.

Right hand wing rail (28) has a mainline wheel running surface (40) which supports the tread (12) of a new wheel (10) or tread (18) of a worn wheel (10A) as depicted in FIG. 3 and a mainline gage line (42) which engages the contact surface (14) or (20) of the flange (16) of a railroad car wheel (10, 10A). Wing rail (28) also has a wing receiving section (44) which receives a wing (46) of a manganese insert (48) and a guard rail section (50) having a flared end (51). By making end (51) flared a wheel traversing frog (26) in a trailing movement direction, i.e. from the heel end (38) toward the toe end (32) cannot strike the end of guard rail section (50). The guard rail section (50) functions to guide a railroad car wheel traveling in a flangeway (52) defined between one side (54) of insert (48) and guard rail section (50). The side (54) of insert (48) defines the gage line for a wheel moving across the turnout line running surface (56) of insert (48).

Left hand wing rail (30) has a turnout wheel running surface (58) which supports the tread (12) of a new wheel (10) or tread (18) of a worn wheel (10A) moving along the turnout rail and a turnout gage line (60) which engages the contact surface (14) or (20) of the flange (16) of a car wheel (10) or (10A) moving along a turnout rail. Wing rail (30) also has a wing receiving section (62) adapted to receive a wing (64) of manganese insert (48) and a guard rail section (66). Guard rail section (66) has a flared end (67) and functions to guide a wheel which traverses a flangeway (70) defined between one side (72) of insert (48) and guard rail (66). Side (72) of insert (48) defines the mainline gage line for a wheel moving across the mainline running surface (68) of insert (48)

Manganese insert (48) has a frog point (74) with a tip (76) positioned between a pair of longitudinally extending wings (46 and 64) near the frog throat (78).

The manganese wings (46 and 64) provide transition surfaces for railroad car wheels moving between the turnout and mainline running surfaces (56 and 68) formed o the top surface of insert point (74) and the mainline and turnout wing running surfaces (40 and 58).

In the railbound manganese frog (26) of the present invention, a series of modifications have been made to the wing rails (28 and 30) at the toe end of the frog, to the manganese wings (46 and 64), the manganese point (74), the heel end of the manganese insert and to the heel rails (34 and 36). These modifications now will be described in connection with the cross sectional views shown in FIG. 2 and FIGS. 4 through 13.

Looking again at FIG. 1, false flange ramps (80 and 82) are formed in wing rails (28 and 30) respectively at the throat (78) of the frog and adjacent to the points at which the wing rails (28 and 30) ar bent outwardly to form the wing receiving sections (44 and 62). The false flange ramps (80 and 82) are cut across the top of the heads of the wing rails (28 and 30). The flange ramps (80 and 82) are cut parallel to the gage lines (42 and 60) for the wing rails (28 and 30). The false flange ramps (80 and 82) taper and have a width equal to the width of the wheel plus and minus the amount of lateral movement a wheel can experience as it moves through the frog. The false flange ramps (80 and 82) have a beginning depth approximately equal to that of a false flange (22) formed on a worn wheel (10A) and rises to the surface of the wing receiving sections (44 and 62). The false flange ramps (80 and 82) act to raise a railroad car wheel (10A) onto the top of the respective wing rail and manganese casting by its false flange (22). By providing a pathway for the false flange (22) of a worn railroad car wheel (10A) the wheel's true flange (16) remains in the flangeway or throat to guide the wheel through the frog. Thus, the false flange ramps (80 and 82) eliminate the sudden impact to the side of a wing rail which would otherwise occur when a wheel's false flange strikes the outside of the wing rail head in a point facing movement.

Figure 4:
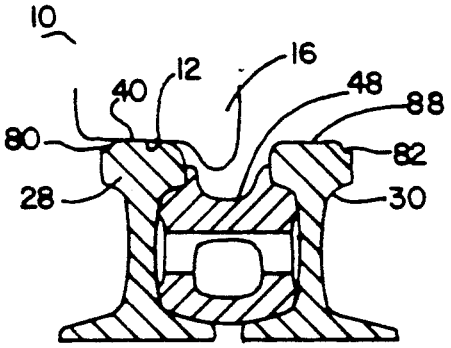
FIG. 4 is a view along line 4—4 of FIG. 1 showing a new car wheel bearing against the top surface of the right hand wing rail.
Figure 4A:
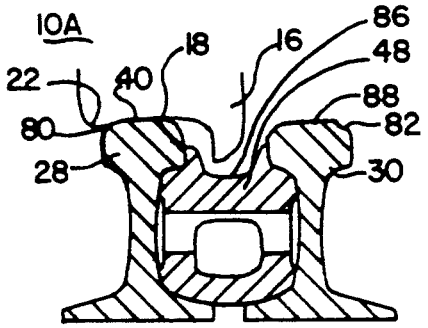
FIG. 4A a view along line 4—4 of FIG. 1 showing a worn railroad car wheel having a false flange bearing against the top surface of the right hand wing rail.
Figure 5:
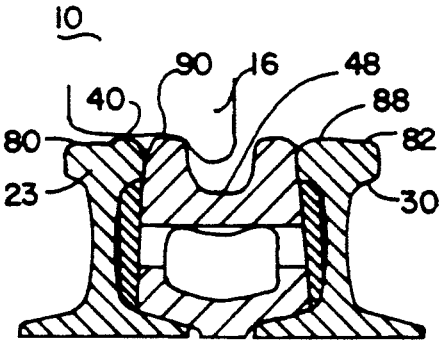
FIG. 5 is a view along line 5—5 of FIG. 1 showing a new car wheel having its tread supported on the top surface of the right hand wing of the manganese insert.
Figure 5A:
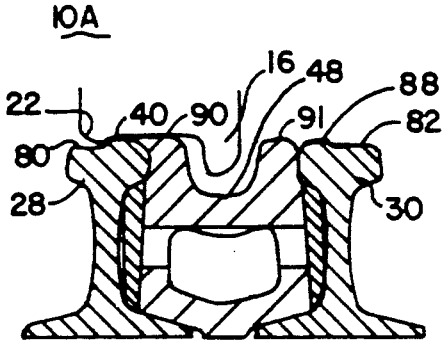
FIG. 5A is a view along line 5—5 of FIG. 1 showing a worn wheel with a false flange in which the false flange is supported on the top surface of the right hand wing rail at the same time the wheel tread is supported on the right hand wing of the manganese insert.

FIGS. 4 and 5 show a new wheel (10) traversing wing rail (28). The tread (12) of wheel (10) runs across the mainline running surface (40) of wing rail (28). Inasmuch as wheel (10) has no false flange formed thereon no part of wheel (10) enters false flange ramp (80). In contrast thereto it may be seen by referring to FIGS. 4A and 5A that when a worn wheel (10A) having a tread (18) traverses the mainline running surface (40), the false flange (22) enters the false flange ramp (80) and flange (16) remains within flangeway (86). Additionally, it may be seen that the width of false flange ramps (80 and 82) increase in the facing movement direction. From observing FIGS. 4 through 5A it may be seen that a railroad car wheel (10), (10A) moves from a mainline running surface (40) onto a mainline running surface (90) on wing (46) and from a turnout running surface (88) onto a turnout wing running surface (91) when the wheels are in a facing movement direction.

Figure 6:
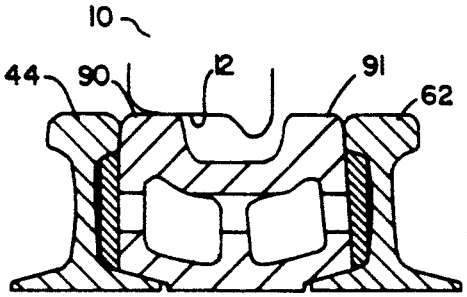
FIG. 6 is a view along line 6—6 of FIG. 1 showing the tread of a new car wheel bearing against the top surface of the right hand manganese wing.
Figure 6A:
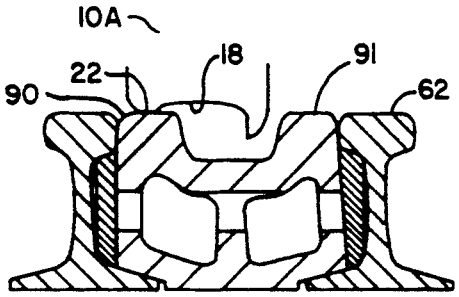
FIG. 6A is a view along line 6—6 of FIG. 1 showing the false flange of a worn wheel bearing against the top surface of the right hand wing.

Turning to FIGS. 6 and 6A, it may be seen that a new wheel (10) or a used wheel (10A) which has developed a false flange (22) are supported solely on the mainline running surface (90) as it traverses the frog throat (78). Similarly, a wheel traversing the turnout line in this area would be supported solely on turnout wing running surface (91) of wing (64).

Figure 7:
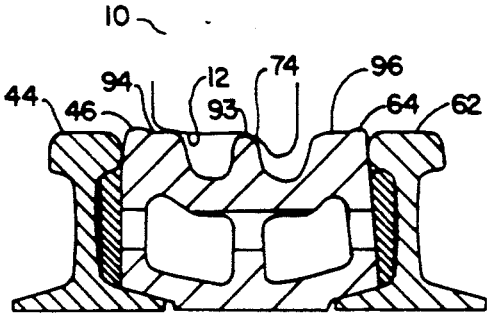
FIG. 7 is a view along line 7—7 of FIG. 1 showing the tread of a new car wheel supported simultaneously on the right hand wing and the point of the manganese insert.
Figure 7A:
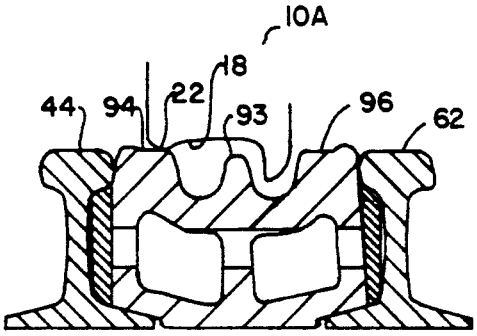
FIG. 7A is a view along line 7—7 of FIG. 1 showing the false flange of a worn railroad car wheel supported on the right hand wing of the manganese insert.
Figure 8:
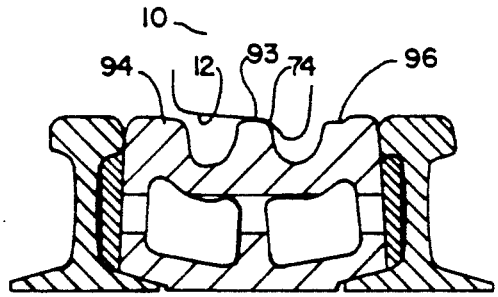
FIG. 8 is a view along line 8—8 of FIG. 1 showing the tread of a new car wheel supported on the point of the manganese insert.
Figure 8A:
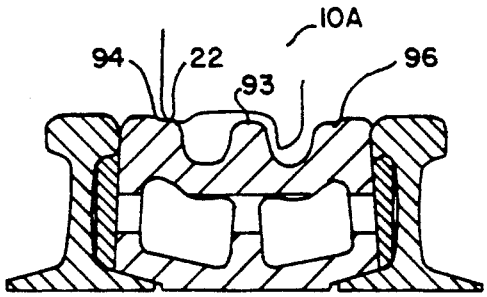
FIG. 8A is a view along line 8—8 of FIG. 1 showing the false flange of a worn railroad car wheel supported on the right hand wing of the manganese insert.

The treads (12 and 18) of new and worn wheels (10 and 10A) will ride on the running surfaces of the manganese wings through the throat area (78) to just beyond the half inch point of frog. The tread (12) of a new wheel (10) will transfer to the top surface (97) of the frog point in this general area. The top surface (97) is sloped (93) in such a manner that it rises to meet the wheel tread (12) as the wheel moves towards the heel (38). Turning to FIGS. 1, 7 and 8, it may be observed that downward sloping ramps (94 and 96) are formed on the manganese wings (46 and 64) respectively. The ramps (94 and 96) extend parallel to and approximately the same length as the ramp (93) for the top surface (92) of frog point (74). Ramps (93, 94 and 96) function to ease the transition of a worn wheel (10A) having a false flange (22) from wings (46 and 64) onto the frog point (74). Looking to FIGS. 7A and 8A, it may be seen that the downward sloping ramp (94) supports the false flange (22) of worn wheel (10A) and assists in lowering it onto the rising ram (93) of frog point (74). Stated differently, the downward sloping wing ramps (94 and 96) eliminate the crushing of the manganese frog point (74) that occurs in standard frogs when a wheel riding on its false flange is pulled off the wing by the frog angle causing the wheel to drop a distance which may be as great as one-half inch onto the point surface (92).

As the wheel moves towards the heel from the frog point tip (76) the frog point (74) becomes wider due to the frog angle. Thus, a wheel having a false flange that was lowered off of a wing now must be allowed to climb onto the top surface (92) of the frog to enable it to ride on either the turnout line running surface (56) or the mainline running surface (68).

Figure 9:
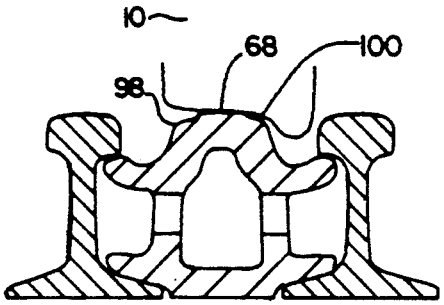
FIG. 9 is a view along line 9—9 of FIG. 1 showing the tread of a new car wheel supported on the center of the manganese insert point.
Figure 9A:
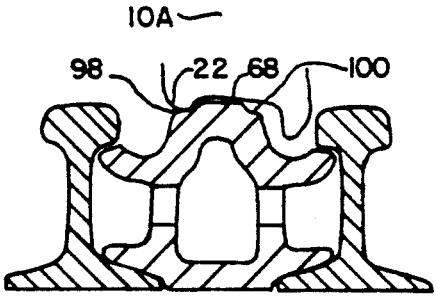
FIG. 9A is a view along line 9—9 of FIG. 1 showing a worn railroad car wheel having a false flange supported on a ramp formed on the point of the manganese insert.
Figure 10:
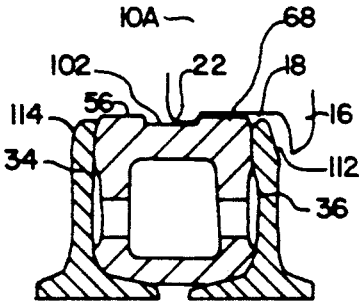
FIG. 10 is a view along line 10—10 of FIG. 1 showing a worn railroad car wheel having a false flange supported on a tapered surface formed in the heel extension of a manganese insert.
Figure 11:
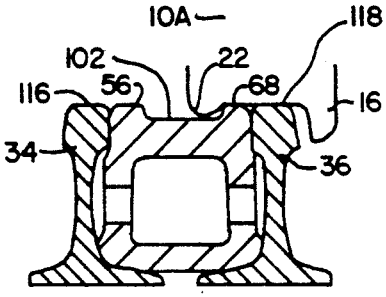
FIG. 11 is a view along line 11—11 of FIG. 1 showing a worn railroad car wheel having a false flange supported in a ramp formed in the heel extension of the manganese insert point and the tread supported on the left hand running surface of the heel rail.

FIGS. 9 and 9A illustrate a pair of ramps (98 and 100) formed in the top surface (92) of frog point (74) to assist a wheel having a false flange to move onto mainline running surface (68) or the turnout line running surface (56). FIG. 9 illustrates a new wheel (10) with no false flange moving directly onto mainline running surface (68). FIG. 9A discloses the false flange (22) of a worn wheel (10A) received in ramp (98) to assist the wheel in climbing onto top surface (92).

Figure 12:
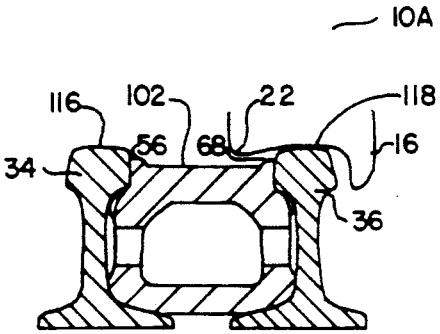
FIG. 12 is a view along line 12—12 of FIG. 1 illustrating a worn railroad car wheel illustrating the tread of the wheel supported solely on the head of the left hand heel rail and illustrating the side of the rail head planed to the same angle as the manganese gage line along the mainline running surface.
Figure 13:
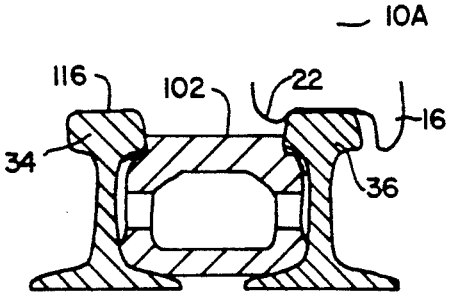
FIG. 13 is a view along line 13—13 of FIG. 1 showing a worn railroad car wheel having a tread supported fully on the head of the left hand heel rail.

At the heel end (38) of frog (26) a car wheel transfers from one of the turnout line running surface (56) or the mainline running surface (68) to one of the right hand or left hand heel rails (34 and 36). In the frog (26) of the present invention heel (38) is made symmetrical about the centerline of the frog. In the heel area (38), a central, downwardly sloped longitudinally extending heel ramp (102) extends from between the turnout and mainline running surfaces (56 and 68) to between the right hand and left hand heel rails (34 and 36). Additionally, the outer ends (104 and 106) of the right hand and left hand heel rails (34 and 36) are tapered and the rail tips (108 and 110) form a tapered joint with the insert (48). At the rail tips (108 and 110) the rail is 0.5625 inches wide and its top surface has been machined to slope downwardly to 0.25 inches below the surface of the adjacent manganese. The reduced width of the rails and the downward slope thereof may be seen in FIG. 10 which is a section near the top of heel ramp (102). At this location, the false flange (22) of worn wheel (10A) is received in heel ramp (102) and wheel tread (18) rides on mainline running surface (68). The sloped and reduced width portion (112) of rail (36) ensures that the wheel flange (16) will avoid striking the end and top surface of the rail. A similar tapered slope (114) may be seen on heel rail (34). As wheel (10A) progresses towards the end of heel (38) the top surface (118) of left hand heel rail (36) rises to the same level as mainline running surface (68) to cause the wheel tread (18) to transfer onto the heel rail. Similarly, the right hand heel rail top surface (116) rises to the level of the turnout line running surface (56). Additionally, the thickness of the heads of heel rails (34 and 36) increase as may be seen by referring to FIG. 11. FIGS. 12 and 13 show the further reduction in the width of the turnout and mainline running surfaces (56 and 68) and the transfer of the tread (18) of worn wheel (10A) onto the top surface (118) of left hand heel rail (36).

Figure 2:
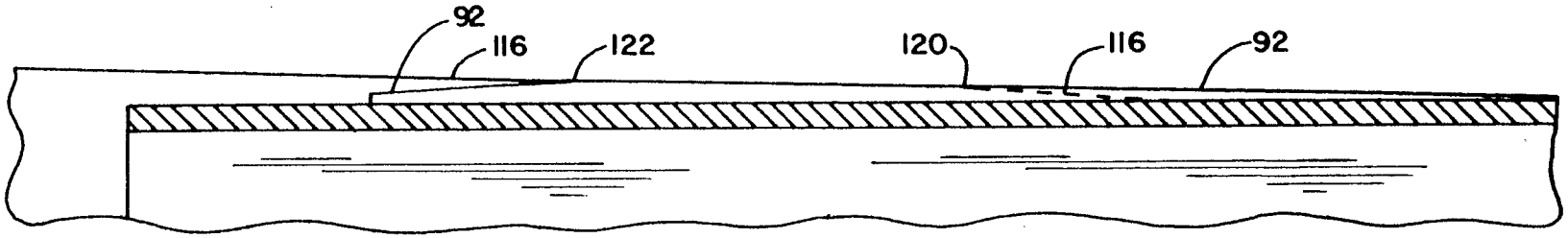
FIG. 2 is a view along line 2—2 of FIG. 1.

The relative heights of the heel rail and of the manganese insert (48) at the heel end also may be seen by referring to FIG. 2. At the right side of FIG. 2 it may be observed that the top surface (116) of right hand heel rail (34) is below the top surface (92) of insert (48). At point (120) to point (122) the rail height and the height of the manganese insert are approximately equal. Thereafter, the top surface (92) of the manganese falls beneath the level of the top surface (116) of rail (34).

From the above it may be observed that the ramps that have been formed in the wing rails to accommodate the false flanges of wheels passing onto the manganese wings and the ramps that have been formed in the manganese wings and at the frog point together with the heel ramp and tapered end portions of the heel rails function to reduce greatly the impacts which may occur at wheel transfer zones in manganese frogs. As stated previously, the elimination of these impacts greatly reduce the wear of manganese frogs and reduce the noise levels of railroad cars moving through rail frogs.

As stated previously, the subject invention applies to railbound manganese spring frogs as well as to railbound manganese rigid frogs.

Figure 14:
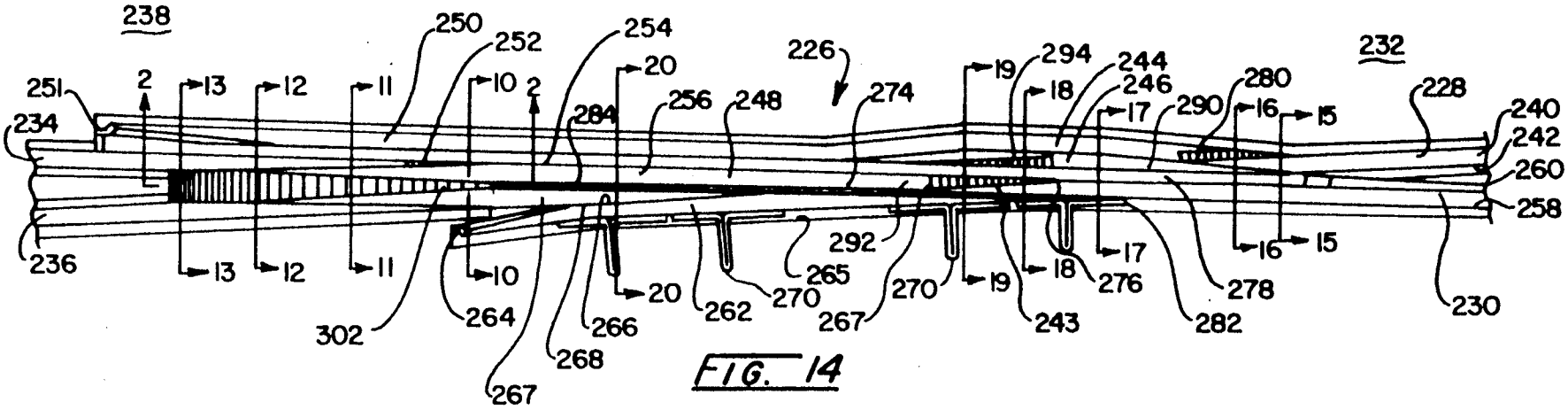
FIG. 14 is a plan view of a railbound manganese spring frog of the present invention.

Turning to FIG. 14 of the present invention, a railbound manganese spring frog (226) may be seen by referring to FIG. 14. It may be recalled that in connection with the description of the railbound manganese rigid frog (26) that frog (26) was symmetrical about its longitudinal centerline. Accordingly, frog (26) may be adapted for use in applications where either a left hand or a right hand frog is required. In the aforementioned description it was determined arbitrarily that the turnout gage line would be described as being on the right side of the frog point as viewed from the toe and the mainline gage line would be described as being o the left hand side of the point as viewed from the toe. Thus, the description in connection with rigid frog (26) covered a right hand frog. With respect to spring rail frogs, convention dictates that a spring rail frog is right hand when the wing moves to the right looking from the toe towards the point of frog and left-hand when the wing moves to the left looking from the toe towards the point of frog. Accordingly, the description of spring frog (226) covers a left-hand spring frog. Spring frog (226) has a right hand or rigid wing rail (228) and a left-hand or spring wing rail (230). Rigid wing rail (228) connects to a turnout gage line not shown whereas spring wing rail (230) connects to a mainline gage rail not shown. Right hand and left-hand heel rails (234 and 236) are attached to frog (226) at the heel end (238) thereof a will be described hereinafter in greater detail.

Rigid wing rail (228) has a turnout line running surface (240) which supports the tread (12) of a new wheel (10) or tread (18) of a worn wheel (10A) as depicted in FIG. 3 and a turnout gage line (242) which engages the contact surface (14) or (20) of the flange (16) of a railroad car wheel (10, 10A). Rigid rail (228) also has a wing receiving section (244) which receives a wing (246) of a manganese insert (248) and a guard rail section (250) having a flared end (251). Flared end (251) functions to prevent a railroad car wheel moving from heel end (238) towards toe end (232) from striking the end of guard rail section (250). The guard rail section (250) acts to guide a railroad car wheel having a flange traveling in a flangeway (252) defined between one side (254) of insert (248) and guard rail section (250). The side (254) of insert (248) defines the gage line for a wheel moving across the mainline running surface (256) of insert (248).

Spring wing rail (230) has a mainline running surface (258) which supports the tread (12) of a new wheel (10) or tread (18) of a worn wheel (10A) moving along the mainline rail and a mainline gage line (260) which engages the contact surface (14 or 20) of the flange (16) of a car moving along the mainline rail. It should be noted that rigid rail (228) and spring rail (230) are rigidly attached to each other by means of a toe end spacer block located a minimum of 8 feet ahead of the half inch point of frog (276). In other words, the spacer block, not shown would be located to the right of the toe end (232) of frog (226) as viewed in FIG. 14. The spacer block also forms the point of flexure for spring wing (230). Spring wing (230) also has a outwardly bent free end (262) with a flared tip (264). A plurality of springs, not shown, act against the outer surface (265) of spring rail (230) to cause the inner surface (266) thereof to be clamped against the turnout gage line side (268) of insert (248). A plurality of horns (270) fit into forged pockets called hold down housings, not shown, which are welded into the base plate and act to prevent the free end (262) of spring wing (230) from moving vertically. When a railroad car wheel moves along rigid wing rail (228) in a facing movement direction it will traverse frog throat (278). When it reaches the half inch point of frog (276), it will wedge between the turnout gage line side (268) of insert (248) and the inner surface (266) of spring wing (230) to cause the wing to move away from the insert and provide a flange space between wing (230) and insert (248).

Looking again to FIG. 14, it may be observed that manganese insert (248) has a frog point (274) commencing at a tip or half inch point of frog (276) and a single longitudinally extending wing (246) near the frog throat (278). Manganese wing (246) provides a transition surface for a railroad car wheel moving between the turnout line running surface (240) of rigid wing rail (228) and a turnout running surface (267).

The rigid wing rail (228) side of spring frog (226) and heel rails (234 and 236) have been modified in the same manner as those elements have been modified in connection with rigid frog (26) described above. Referring again to FIG. 14, a false flange ramp (280) is formed in rigid wing rail (228) at throat (278) at the location at which the wing rail has been bent outwardly to form the wing receiving section (244). The false flange ramp (280) is cut across the head of wing rail (228) parallel to turnout gage line (242). Ramp (280) tapers and has a width equal to the width of a railroad car wheel plus and minus the amount of lateral movement a wheel may experience as it moves through the frog. The beginning depth of false flange ramp (82) amounts to approximately that of a false flange (22) formed on a worn wheel (10A) and rises to the surface of the wing receiving sections. As with the rigid wing frog (26), the false flange ramp (280) acts to raise a railroad car wheel (10A) onto the top of the head of wing rail (228) and manganese casting wing (246) by its false flange (22). By providing a pathway for the false flange (22) of a worn railroad car wheel (10A), the wheels true flange (16) remains in the flangeway or throat to guide the wheel through the frog. Thus, the flange false ramp (280) eliminates the sudden impact to the side of wing rail (228) which would otherwise occur when a wheel's false flange strikes the outside of the wing rail head in a point facing movement.

Figure 15A:
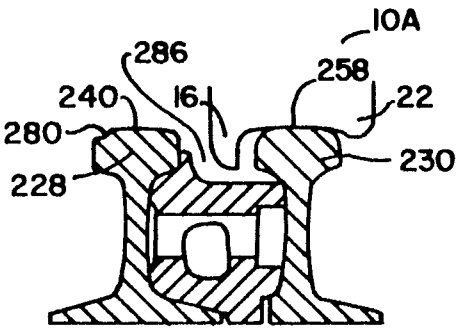
FIG. 15A is a view along line 15—15 of FIG. 14 showing a worn railroad car wheel having a false flange bearing against the top surface of the mainline rail.
Figure 15:
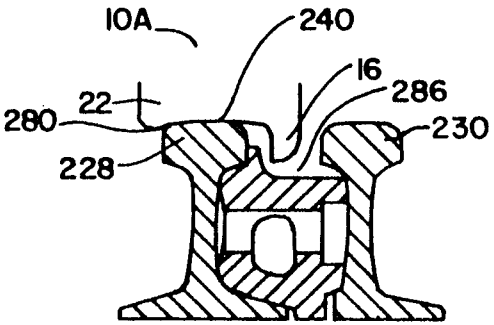
FIG. 15 is a view along line 15—15 showing a worn railroad car wheel having a false flange on the turnout rail.
Figure 16:
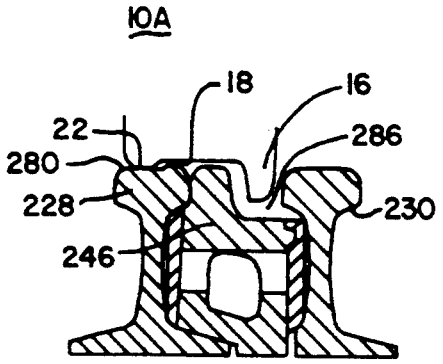
FIG. 16 is a view along line 16—16 of FIG. 14 showing a worn railroad car wheel having a false flange bearing simultaneously against the top surface of the turnout rail and-the wing of a manganese insert.
Figure 16A:
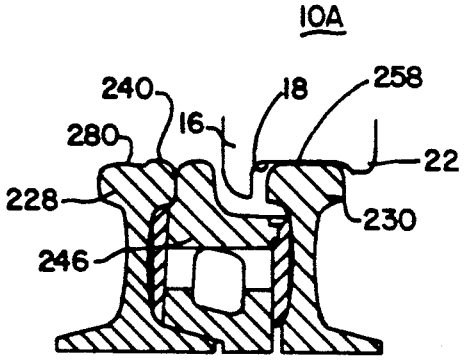
FIG. 16A is a view along line 16—16 of FIG. 14 showing a worn railroad car wheel having a false flange and bearing against the top of the mainline rail.

Turning to FIGS. 15 and 16, these figures depict a worn wheel (10A) traversing wing rail (228). It may be seen that as wheel (10A) traverses turnout line running surface (240) in a facing movement direction, the false flange (22) enters the false flange ramp (280) and flange (16) remains within flangeway (286). Also, it may be observed that the width of false flange ramp (280) increases and its surface rises in the facing movement direction. Turning to FIGS. 15A and 16A, a worn wheel (10A) may be seen traversing mainline running surface (258) of spring wing rail (230). Inasmuch as the mainline running surface (258) of spring wing rail (230) remains straight through frog throat (278), wing rail (230) does not require a false flange ramp equivalent to ramp (280) of rigid wing rail (228). It should be observed that in FIGS. 15, 15A, 16 and 16A spring rail (230) is shown in the closed position.

After wheel (10A) has traversed false flange ramp (280), the wheel (10A) will be supported by its false flange (22) on turnout wing running surface (290) of wing (246). As wheel (10A) traverses frog throat (278), flange (16) bears against the inner surface (266) of spring rail (230) to cause it to move away from manganese insert (248).

Figure 17:
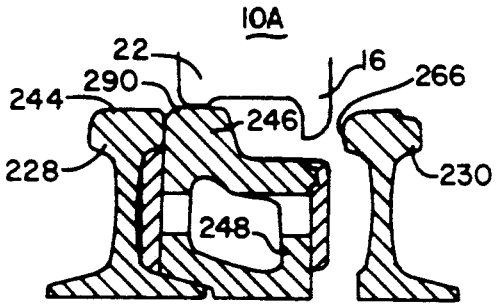
FIG. 17 is a view along line 17—17 of FIG. 14 showing a worn railroad car wheel having a false flange supported solely on the wing of the manganese insert and showing the spring wing rail moved away from the long point rail to provide a passageway for the wheel flange.
Figure 17A:
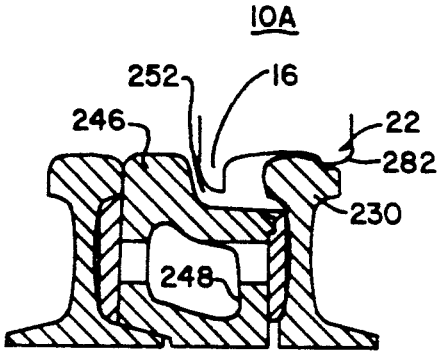
FIG. 17A is a view along line 17—17 of FIG. 14 showing a worn railroad car wheel having a false flange bearing against the top of the mainline rail.

As a worn wheel (10A) moves along mainline running surface (258) of spring wing rail (230) in a facing movement direction it will pass through frog throat (278) and thereafter move onto mainline running surface (256) of insert (248). FIG. 17A shows a false flange groove (282) machined into the top surface o spring rail (230) parallel to the mainline gage line (260). False flange groove (282) accommodates the false flange (22) of a worn wheel (10A). This flange must move across the head of spring wing rail (230) as it moves on to the top surface (292) of insert (274). FIG. 17A shows that the inner surface (266) on the head of spring wing (230) is undercut to match the slope of the side wall of the manganese frog point (274). The complementary angled side surface of manganese (274) may be seen by referring to FIG. 18 and 18A as well. The angle is referred to as a one in five angle. This angle is machined on the gage side of heel rails (234 and 236) at the heel end of the structure. Because the heel end (238) of spring frog (226) is the same as the heel area (38) of rigid frog (26) these cross sections are not illustrated again in connection with FIG. 14.

Referring again to FIG. 14, it may be observed that the false flange groove (282) formed in the top surface of spring rail (230) and parallel to gage line (260) is continued onto the top surface (292) of manganese frog point (274). Numeral (284) identifies the false flange groove on the top surface of frog point (274). Insert groove (284) is aligned axially with rail groove (282). This groove has a depth of approximately 0.25 inches throughout and terminates at the entrance to heel ramp (302).

Figure 18:
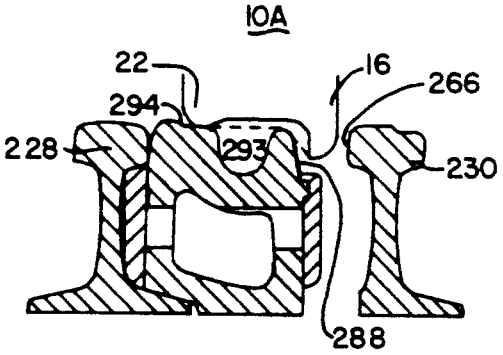
FIG. 18 is a view along line 18—18 of FIG. 14 showing in solid line a worn railroad car wheel bearing against the top surface of the wing portion of the manganese insert on the turnout side of the frog and in a dotted line a new railroad car wheel simultaneously engaging the top surface of the wing and the point of the manganese insert on the turnout side of the frog and showing the wing rail moved away from the long point rail to provide a for the wheel flange.
Figure 18A:
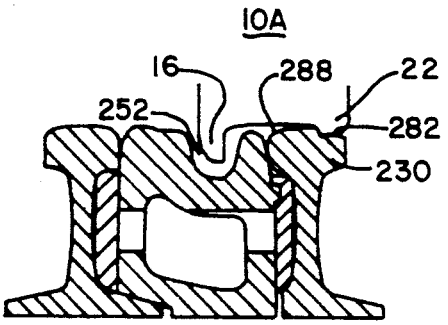
FIG. 18A is a view along line 18—18 of FIG. 14 showing a worn railroad car wheel having a false flange engaging the top surface of the mainline rail.
Figure 19:
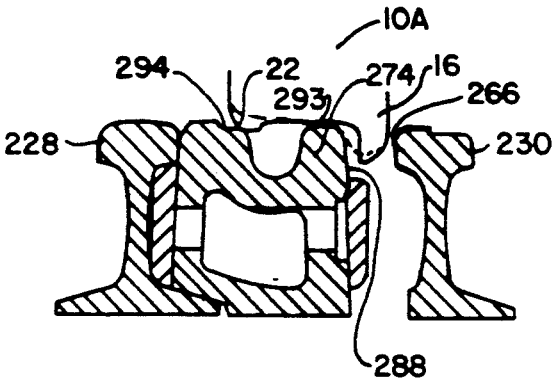
FIG. 19 is a view along line 19—19 of FIG. 14 showing in solid line a worn railroad car wheel having a false flange engaging the top surface of the wing portion of the insert just prior to transferring to the point portion of the manganese insert on the turnout side of the frog and in dotted lines a new railroad car wheel riding solely on the top surface of the point of the manganese insert on the turnout side of the frog and showing the spring wing rail moved away from the long point rail to provide a passageway for the wheel flange.
Figure 19A:
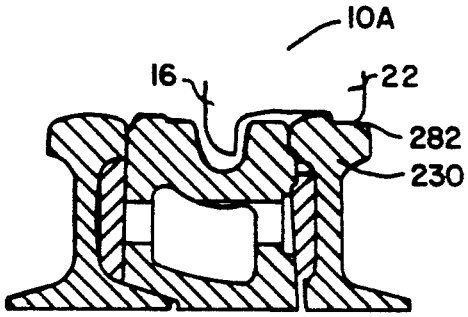
FIG. 19A is a view along line 19—19 of FIG. 14 showing a worn railroad car wheel engaging the top surface of the mainline wheel.

Looking again to FIG. 14 and FIGS. 18, 18A, 19 and 19A it may be observed that a downward sloping ramp (294) is formed on manganese wing (246). Ramp (294) extends parallel to and approximately the same length as a ramp (293) formed on the top surface (292) of frog point (274). Ramps (293 and 294) ease the transition of a worn wheel (10A) having a false flange (22) from wing (246) onto the frog point (274). From FIGS. 18 and 19, it may be observed that the downward sloping ramp (294) supports the false flange (22) of worn wheel (10A) and assists in lowering it onto the rising ramp (293) of frog point (274). FIGS. 18 and 19 depict a worn wheel (10A) moving onto frog point (274). As it does so, wheel flange (16) moves the sloped surface (266) of the head of spring wing rail (230) away from the sloped surface (288) of frog point (274) to define a wheel flangeway therebetween. FIGS. 18A and 19A depict the false flange groove (282) machined across the top of the head of spring wing rail (230). This groove enables the flange (16) of a worn wheel (10A) to remain within flangeway (252) as the wheel traverses the mainline side of frog point (274).

Figure 20:
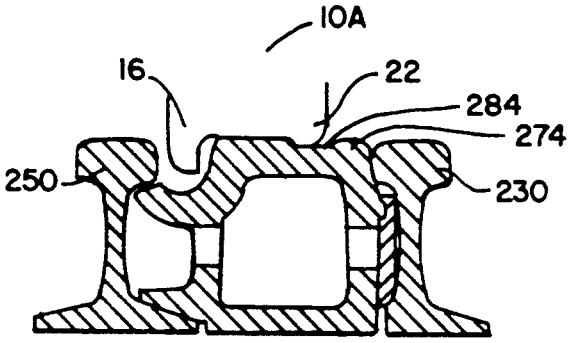
FIG. 20 is a view along line 20—20 of FIG. 14 showing a worn railroad car wheel having a false flange riding in a false flange groove formed on the top surface of the manganese insert moving along the mainline side of the frog.

False flange groove (284) formed in the top surface of frog point (274) also may be seen by observing FIG. 20. It may be seen that groove (284) remains parallel to the mainline gage line for flange (16) of wheel (10A).

From the above, it may be observed that the railbound manganese spring frog (226) of the present invention differs from the railbound manganese rigid frog (26) only at the toe end (232) of the frog and in the area of the frog throat (278). The spring wing frog (226) has a longitudinally extending false flange groove formed in the top surface of the spring wing rail (230) in the frog point (274) which groove extends parallel to the mainline gage line. This groove does not exist in the rigid frog (26). In contrast thereto rigid frog (26) has a pair of sloping wing rail ramps and manganese wing ramps whereas the spring frog (226) has only one of each.

From the above it may be seen that the railbound manganese frogs of the present invention prevent wheels having false flanges from impacting critical components of the frogs.

Since certain changes may be made in the above-described system and apparatus not departing from the scope of the invention herein and above, it is intended that all matter contained in the description or shown in the accompanying drawings shall be interpreted as illustrative and not in a limiting sense.

We claim:

1. A frog assembly having a toe end and a heel end adapted to be inserted at the intersection of a mainline rail and a turnout rail which comprises:

a base plate;

a longitudinally extending manganese insert with a heel end having a frog point commencing at the intersection of the mainline and turnout line gage lines and a heel extension having a first side and a second side connected to said frog point and a toe end having a first manganese wing and a second manganese wing which extend along each side of said frog point to define a wheel flangeway therebetween mounted on said base plate;

wherein said manganese insert point has a top surface which defines a mainline running surface and a turnout line running surface for railroad car wheels and a pair of side surfaces;

a first wing rail which has a mainline wheel running surface section, a first manganese wing receiving section which receives said first manganese wing and a first guard rail section mounted on said base plate and a second wing rail which has a turnout wheel running surface section, a second manganese wing receiving section which receives said second manganese wing and a second guard rail section mounted on said base plate;

wherein said first manganese wing provides a first transition surface between said first wing rail wheel running surface section and said mainline running surface on said point and said second manganese wing provides a second transition surface between said second wing rail wheel running surface section and said turnout line running surface on said point and wherein said first and second wing rail guard sections extend along and parallel to the heel of said insert such that a wheel flangeway is defined between each of said insert side surfaces and an adjacent wing rail guard section;

a first heel rail mounted on said base plate and attached to the first side of said heel extension to abut said turnout line running surface on said point and a second heel rail mounted on said base plate and attached to the second side of said heel extension to abut said main line running surface on said point;

wherein said first heel rail cooperates with said first wing rail guard section to define a wheel flangeway therebetween and said second heel rail cooperates with said second wing rail guard section to define a wheel flangeway therebetween;

a ramp adapted to receive a false flange on a railroad car wheel formed in the top surface of the head of the first wing rail parallel to the mainline wheel running surface of the first wing rail which ramp extends upwardly from approximately 0.375 inches below the rail top surface at one end of said wing receiving section to said rail top surface approximately one half the distance to the point of frog; and a ramp adapted to receive a false flange on a railroad car wheel formed in the top surface of the head of the second wing rail parallel to the turnout line wheel running surface of the second wing rail which ramp extends upwardly from approximately 0.375 inches below the rail top surface approximately one half the distance to the point of frog.

2. A frog assembly having a toe end and a heel end adapted to be inserted at the intersection of a mainline rail and a turnout rail which comprises:

a base plate;

a longitudinally extending manganese insert with a heel end having a frog point commencing at the intersection of the mainline and turnout line gage lines and a heel extension having a first side and a second side connected to said frog point and a toe end having a first manganese wing and a second manganese wing which extend along each side of said frog point to define a wheel flangeway therebetween mounted on said base plate;

wherein said manganese insert point has a top surface which defines a mainline running surface and a turnout line running surface for railroad car wheels and a pair of side surfaces;

a first wing rail which has a mainline wheel running surface section, a first manganese wing receiving section which receives said first manganese wing and a first guard rail section mounted on said base plate and a second wing rail which has a turnout wheel running surface section, a second manganese wing receiving section which receives said second manganese wing and a second guard rail section mounted on said base plate;

wherein said first manganese wing provides a first transition surface between said first wing rail wheel running surface section and said mainline running surface on said point and said second manganese wing provides a second transition surface between said second wing rail wheel running surface section and said turnout line running surface on said point and wherein said first and second wing rail guard sections extend along and parallel to the heel of said insert such that a wheel flangeway is defined between each of said insert side surfaces and an adjacent wing rail guard section;

a first heel rail mounted on said base plate and attached to the first side of said heel extension to abut said turnout line running surface on said point and a second heel rail mounted on said base plate and attached to the second side of said heel extension to abut said main line running surface on said point;

wherein said first heel rail cooperates with said first wing rail guard section to define a wheel flangeway therebetween and said second heel rail cooperates with said second wing rail guard section to define a wheel flangeway therebetween;

a point ramp formed on said manganese insert which simultaneously widens and slopes upwardly toward the top surface of said insert commencing at the insert point and extending toward said heel extension;

a first manganese wing ramp adapted to receive a false flange on a railroad car wheel formed on said first manganese wing which simultaneously narrows and slopes downwardly from the top surface of said first manganese wing commencing at an initial location aligned perpendicularly with said insert point and extending toward said heel parallel to the mainline wheel running surface of said manganese insert;

a second manganese wing ramp adapted to receive a false flange on a railroad car wheel formed on said second manganese wing which simultaneously narrows and slopes downwardly from the top surface of said first manganese wing commencing at an initial location aligned perpendicularly with said frog point and extending toward said heel parallel to the turnout line wheel running surface of said manganese insert; and wherein said point ramp rises to receive a wheel tread surface as the same is being lowered simultaneously by one of said first and second manganese wing ramps toward said point ramp.

3. The frog assembly of claim 2 wherein the width of said first wing ramp is defined by a longitudinal wall which extends parallel to the main line wheel running surface of said manganese insert and the width of said second wing ramp is defined by a longitudinal wall which extends parallel to the turnout line wheel running surface of said manganese insert.

4. A frog assembly having a toe end and a heel end adapted to be inserted at the intersection of a mainline rail and a turnout rail which comprises:

a base plate;

a longitudinally extending manganese insert with a heel end having a frog point commencing at the intersection of the mainline and turnout line gage lines and a heel extension having connected to said frog point and a toe end having a first manganese wing and a second manganese wing which extend along each side of said frog point to define a wheel flangeway therebetween mounted on said base plate;

wherein said manganese insert point has a top surface which defines a mainline running surface and a turnout line running surface for railroad car wheels and a pair of side surfaces;

a first wing rail which has a mainline wheel running surface section, a first manganese wing receiving section which receives said first manganese wing and a first guard rail section mounted on said base plate and a second wing rail which has a turnout wheel running surface section, a second manganese wing receiving section which receives said second manganese wing and a second guard rail section mounted on said base plate;

wherein said first manganese wing provides a first transition surface between said first wing rail wheel running surface section and said mainline running surface on said frog point and said second manganese wing provides a second transition surface between said second wing rail wheel running surface section and said turnout line running surface on said frog point and wherein said first and second wing rail guard sections extend along and parallel to the heel of said insert such that a wheel flangeway is defined between each of said insert side surfaces and an adjacent wing rail guard section;

a first heel rail mounted on said base plate with a head having a longitudinally tapered inner end which overlies a complementary tapered first section on said heel extension adjacent one end of the turnout line running surface on the frog point to provide a transition from said turnout line running surface to a running surface on said first heel rail head and a second heel rail mounted on said base plate with a head having a longitudinally tapered inner end which overlies a complementary tapered second section on said heel extension adjacent one end of the mainline running surface on the frog point to provide a transition from said mainline running surface to a running surface on said second heel rail head; and wherein the running surface of the first tapered section of said heel extension adjacent to said turnout line running surface slopes downwardly from said turnout line running surface toward said heel and said tapered inner end of said first heel rail slopes downwardly from said first heel rail running surface toward said frog point and the second running surface of the tapered section of said heel extension adjacent to said mainline running surface slopes downwardly from said mainline running surface toward said heel and said tapered inner end of said second heel rail slopes downwardly from said second heel rail running surface toward said point.

5. The frog assembly of claim 4 in which each of said first and second heel rails have a gage side and an outer side and the gage side of the tapered inner end of the first heel rail head is formed at the same angle as the gage side of the turnout line running surface of said point and the gage side of the tapered inner end of the second heel rail head is formed at the same angle as the gage side of the mainline running surface of said point.

6. A frog assembly having a toe end and a heel end adapted to be inserted at the intersection of a mainline rail and a turnout rail which comprises:

a base plate;

a longitudinally extending manganese insert with a heel end having a frog point commencing at the intersection of the mainline and turnout line gage lines and a heel extension connected to said point and a toe end having at least one rigid manganese wing which extends along one side of said frog point to define a wheel flangeway therebetween mounted on said base plate;

wherein said manganese insert point has a pair of side surfaces and a top surface which defines a mainline running surface and a turnout line running surface for railroad car wheels;

a rigid wing rail which has a turnout line wheel running surface section, a manganese wing receiving section which receives said manganese wing and a rigid wing guard rail section mounted on said base plate;

wherein said rigid manganese wing provides a transition surface between said rigid wing rail wheel running surface section and said turnout running surface on said point and wherein said rigid wing guard rail section extends along and parallel to the heel of said insert such that a wheel flangeway is defined between one of said insert side surfaces and said rigid wing rail guard sections;

a first heel rail mounted on said base plate and attached to said heel extension to abut said mainline running surface on said point and a second heel rail mounted on said base plate and attached to the second side of said heel extension to abut said main line running surface on said point;

wherein said first heel rail cooperates with said rigid wing rail guard section to define a wheel flangeway therebetween; and a ramp adapted to receive a false flange on a railroad car wheel formed in the top surface of the head of the rigid wing rail parallel to the turnout line wheel running surface of the rigid wing rail which ramp extends upwardly from approximately 0.375 inches below the rail top surface at one end of said wing receiving section to said rail top surface approximately one half the distance to the point of frog.

7. A frog assembly having a toe end and a heel end adapted to be inserted at the intersection of a mainline rail and a turnout rail which comprises:

a base plate;

a longitudinally extending manganese insert with a heel end having a frog point commencing at the intersection of the mainline and turnout line gage lines and a heel extension connected to said point and a toe end having at least one rigid manganese wing which extends along one side of said frog point to define a wheel flangeway therebetween mounted on said base plate;

wherein said manganese insert point has a top surface which defines a mainline running surface and a turnout line running surface for railroad car wheels;

a rigid wing rail which has a turnout line wheel running surface section, a manganese wing receiving section which receives said manganese wing and a rigid wing rail guard section mounted on said base plate;

wherein said rigid manganese wing provides a transition surface between said rigid wing rail wheel running surface section and said turnout running surface on said point and wherein said rigid wing guard section extends along and parallel to the heel of said insert such that a wheel flangeway is defined between one of said insert side surfaces and said rigid wing rail guard sections;

a first heel rail mounted on said base plate and attached to said heel extension to abut said mainline running surface on said point and a second heel rail mounted on said base plate and attached to said heel extension to abut said turnout running surface on said point;

wherein said first heel rail cooperates with said rigid wing rail guard section to define a wheel flangeway therebetween;

a point ramp formed on said manganese insert which simultaneously widens and slopes upwardly toward the top surface of said insert commencing at the frog point and extending toward said heel extension;

a rigid manganese wing ramp adapted to receive a false flange on a railroad car wheel formed on said rigid manganese wing which simultaneously narrows and slopes downwardly from the top surface of said rigid manganese wing commencing at an initial location aligned perpendicularly with said insert point and extending toward said heel parallel to the turnout wheel running surface of said manganese insert; and wherein said point ramp rises to receive a wheel tread surface as the same is being lowered simultaneously by said manganese wing ramp toward said point ramp.

8. The frog assembly of claim 7 wherein the width of said rigid wing ramp is defined by an insert wall which extends parallel to the turnout wheel running surface of said manganese insert.

9. A frog assembly having a toe end and a heel end adapted to be inserted at the intersection of a mainline rail and a turnout rail which comprises:

a base plate;

a longitudinally extending manganese insert with a heel end having a frog point commencing at the intersection of the mainline and turnout line gage lines and a heel extension connected to said point and a toe end having at least one manganese wing which extends along one side of said frog point to define a wheel flangeway therebetween mounted on said base plate;

wherein said manganese insert point has a top surface which defines a mainline running surface and a turnout line running surface for railroad car wheels;

a rigid wing rail which has a turnout line wheel running surface section, a manganese wing receiving section which receives said manganese wing and a rigid wing rail guard section mounted on said base plate;

wherein said manganese wing provides a first transition surface between said rigid wing rail turnout wheel running surface section and said turnout running surface on said point and wherein aid rigid wing guard section extends along and parallel to the heel of said insert such that a wheel flangeway is defined between one of said insert side surfaces and an adjacent wing rail guard section;

a first heel rail mounted on said base plate with a head having a longitudinally tapered inner end which overlies a first complementary tapered section on said heel extension adjacent one end of the mainline running surface on the point to provide a transition from said mainline running surface to a running surface on said first heel rail head and a second heel rail mounted on said base plate with a head having a longitudinally tapered inner end which overlies a complementary tapered second section on said heel extension adjacent one end of the turnout running surface on the point to provide a transition from said turnout running surface to a running surface on said second heel rail head; and wherein the top running surface of the first tapered section of said heel extension adjacent to said mainline running surface slopes downwardly from said mainline running surface toward said heel and said tapered inner end of said first heel rail slopes downwardly from said first heel rail running surface toward said point and the second top running surface of the tapered section of said heel extension adjacent to said turnout running surface slopes downwardly from said turnout running surface toward said heel and said tapered inner end of said second heel rail slopes downwardly from said second heel rail running surface toward said point.

10. The frog assembly of claim 9 in which each of said first and second heel rails have a gage side and an outer side and said mainline side and turnout running surfaces of said frog point have a gage side and the gage side of the tapered inner end of the first heel rail head is formed at the same angle as the gage side of the mainline side running surface of said frog point and the gage side of the tapered inner end of the second heel rail head is formed at the same angle as the gage side of the turnout running surface of said frog point.

11. A frog assembly having a toe end and a heel end adapted to be inserted at the intersection of a mainline rail and a turnout rail which comprises:

a base plate;

a longitudinally extending manganese insert with a heel end having a frog point commencing at the intersection of the mainline and turnout line gage lines and a heel extension connected to said point and a toe end having a rigid manganese wing which extends along one side of said frog point to define a wheel flangeway therebetween mounted on said base plate and a spring wing which extends along one side of said frog point;

wherein said manganese insert point has a top surface which defines a mainline running surface and a turnout line running surface for railroad car wheels and a pair of side surfaces;

a rigid wing rail which has a head with a top surface which defines turnout line wheel running surface section, a manganese wing receiving section which receives said manganese wing and a rigid wing rail guard section mounted on said base plate;

a spring wing rail which has a head with a top surface which defines mainline wheel running surface;

wherein said spring rail has a mainline gage line;

wherein said rigid manganese wing provides a transition surface between said rigid wing rail wheel running surface section and said turnout running surface on said point and wherein said rigid wing rail guard section extends along and parallel to the heel of said insert such that a wheel flangeway is defined between one of said insert side surfaces and said rigid wing rail guard section;

a first heel rail mounted on said base plate and attached to said heel extension to abut said mainline running surface on said point and a second heel rail mounted on said base plate and attached to said heel extension to abut said turnout running surface on said point;

wherein said first heel rail cooperates with said rigid wing rail guard section to define a wheel flangeway therebetween;

a ramp adapted to receive a false flange on a railroad car wheel formed in the top surface of the head of the rigid wing rail parallel to the turnout line wheel running surface of the rigid wing rail which ramp extends upwardly from approximately 0.375 inches below the rail top surface at one end of said wing receiving section to said rail top surface approximately one half the distance to the point of frog;

a first groove adapted to receive a false flange formed in the top surface of the head of said spring rail parallel to the mainline gage line;

a second groove adapted to receive a false flange formed in the top surface of the manganese insert parallel to the mainline gage line; and wherein said second groove is axially aligned with said first groove.

12. The frog assembly of claim 11 in which said first and second groove have a depth of about 0.25 inches.

13. A frog assembly having a toe end and a heel end adapted to be inserted at the intersection of a mainline rail and a turnout rail which comprises:

a base plate;

a longitudinally extending manganese insert with a heel end having a frog point commencing at the intersection of the mainline and turnout line gage lines and a heel extension connected to said point and a toe end having a rigid manganese wing which extends along one side of said frog point to define a wheel flangeway therebetween mounted on said base plate and a spring wing which extends along one side of said frog point;

wherein said manganese insert point has a top surface which defines a mainline running surface and a turnout line running surface for railroad car wheels;

wherein said mainline rail and said turnout rail each define a gage line;

a rigid wing rail which has a turnout line wheel running surface section, a manganese wing receiving section which receives said manganese wing and a rigid wing rail guard section mounted on said base plate;

wherein said rigid manganese wing provides a transition surface between said rigid wing rail turnout wheel running surface section and said turnout running surface on said frog point and wherein said rigid wing rail guard section extends along and parallel to the heel of said insert such that a wheel flangeway is defined between one of said insert side surfaces and said rigid wing rail guard section;

a first heel rail mounted on said base plate and attached to said heel extension to abut said mainline running surface on said point and a second heel rail mounted on said base plate and attached to said heel extension to abut said turnout running surface on said frog point;

wherein said first heel rail cooperates with said rigid wing rail guard section to define a wheel flangeway therebetween;

a point ramp formed on said manganese insert which simultaneously widens and slopes upwardly toward the top surface of said insert commencing at the frog point and extending toward said heel extension;

a rigid manganese wing ramp adapted to receive a false flange on a railroad car wheel formed on said rigid manganese wing which simultaneously narrows and slopes downwardly from the top surface of said rigid manganese wing commencing at an initial location aligned perpendicularly with said frog point and extending toward said heel parallel to the turnout wheel running surface of said manganese insert;

wherein said point ramp rises to receive a wheel tread surface as the same is being lowered simultaneously by said manganese wing ramp toward said point ramp;

a first groove adapted to said receive a false flange formed in the top surface of the head of said spring rail parallel to the mainline gage line; and a second groove adapted to said receive a false flange formed in the top surface of the manganese insert parallel to the mainline gage line.

14. The frog assembly of claim 13 in which said first and second grooves have a depth of about 0.25 inches.

15. A frog assembly having a toe end and a heel end adapted to be inserted at the intersection of a mainline rail and a turnout rail which comprises:

a base plate;

a longitudinally extending manganese insert with a heel end having a frog point commencing at the intersection of the mainline and turnout line gage lines and a heel extension connected to said point and a toe end having a manganese wing which extends along one side of said frog point to define a wheel flangeway therebetween mounted on said base plate and a spring wing which extends along one side of said frog point;

wherein said manganese insert point has a top surface which defines a mainline running surface and a turnout line running surface for railroad car wheels;

wherein said mainline rail and said turnout rail each define a gage line;

a rigid wing rail which has a turnout line wheel running surface section, a manganese wing receiving section which receives said manganese wing and a rigid wing rail guard section mounted on said base plate;

a spring wing rail which has a mainline running surface;

wherein said manganese wing provides a first transition surface between said rigid wing rail turnout wheel running surface section and said turnout running surface on said frog point and wherein said rigid wing rail guard section extends along and parallel to the heel of said insert such that a wheel flangeway is defined between one of said insert side surfaces and an adjacent wing rail guard section;

a first heel rail mounted on said base plate with a head having a longitudinally tapered inner end which overlies a first complementary tapered section on said heel extension adjacent one end of the mainline running surface on the point to provide a transition from said mainline running surface to a running surface on said first heel rail head and a second heel rail mounted on said base plate with a head having a longitudinally tapered inner end which overlies a complementary tapered second section on said heel extension adjacent one end of the turnout running surface on the point to provide a transition from said turnout running surface to a running surface on said second heel rail head; and wherein the top running surface of the first tapered section of said heel extension adjacent to said mainline running surface slopes downwardly from said mainline running surface toward said heel and said tapered inner end of said first heel rail slopes downwardly from said first heel rail running surface toward said point and the second top running surface of the tapered section of said heel extension adjacent to said turnout running surface slopes downwardly from said turnout running surface toward said heel and said tapered inner end of said second heel rail slopes downwardly from said second heel rail running surface toward said point;

a first groove adapted to said receive a false flange formed in the top surface of the head of said spring rail parallel to the mainline gage line; and a second groove adapted to said receive a false flange formed in the top surface of the manganese insert parallel to the mainline gage line.

16. The frog assembly of claim 15 in which said first and second grooves have a depth of about 0.25 inches.

* * * * *